United States Patent [19]

Fraser et al.

[11] 4,113,371

[45] Sep. 12, 1978

[54] COLOR DEVELOPMENT SYSTEM

[75] Inventors: Lawrence J. Fraser; Alan Liebman, both of Rochester, N.Y.

[73] Assignee: Xerox Corporation, Stamford, Conn.

[21] Appl. No.: 758,538

[22] Filed: Jan. 12, 1977

[51] Int. Cl.[2] ..... G03G 15/01

[52] U.S. Cl. ..... 355/4; 118/7; 118/645; 222/DIG. 1; 355/3 DD; 355/14

[58] Field of Search ..... 355/4, 3 DD, 14; 118/7, 118/645; 222/DIG. 1

[56] References Cited

U.S. PATENT DOCUMENTS

| | | | |
|---|---|---|---|
| 3,860,337 | 1/1975 | Egnaczak | 355/4 |
| 3,947,107 | 3/1976 | Smith | 355/3 DD |
| 4,043,293 | 8/1977 | Ruckdeschel | 222/DIG. 1 |

*Primary Examiner*—Richard L. Moses

*Attorney, Agent, or Firm*—J. J. Ralabate; C. A. Green; H. Fleischer

[57] ABSTRACT

A development apparatus in which a plurality of differently colored particles are dispensed into a common sump. Differently colored particles are dispensed in a pre-selected ratio to form a resultant mixture of particles in the sump having a pre-selected color. This mixture is subsequently deposited on a latent image rendering the image visible in the pre-selected color.

18 Claims, 3 Drawing Figures

COLOR DEVELOPMENT SYSTEM

BACKGROUND OF THE INVENTION

This invention relates generally to an electrostatographic printing machine, and more particularly concerns an improved development system for use therein.

An electrostatographic printing process forms an electrostatic latent image of an original document and reproduces the image in viewable form on a copy sheet. Electrostatography includes electrophotography and electrography. As is well known, electrophotography employs a photosensitive medium to form, with the aid of electromagnetic radiation, the electrostatic latent image. Contrawise, electrography utilizes an insulating medium to form, without the aid of electromagnetic radiation, the electrostatic latent image. Both of the foregoing processes render the latent image viewable by the process of development, i.e. depositing particles thereon. Frequently, the particles are transferred from the latent image to a copy sheet. Alternatively, the recording sheet on which the latent image is produced may also serve as the copy sheet after the particles have been deposited thereon. In both of the foregoing cases, the resultant toner powder image deposited on the copy sheet is permanently affixed thereto by the application of heat and/or pressure. Hereinafter, an electrophotographic printing machine will be described as an illustrative embodiment.

Electrophotographic printing employs a photoconductive manner which is charged to sensitize the surface thereof. The charged portion of the photoconductive member is exposed to a light image of the original document being reproduced. Exposure of the sensitized portion of the photoconductive member discharges the charge therein selectively in the irradiated areas in accordance with the intensity of the light transmitted thereto. This creates an electrostatic latent image on the photoconductive member corresponding to the original document being reproduced. Development of the electrostatic latent image recorded on the photoconductive member is achieved by bringing a developer material into contact therewith. Generally, the developer material comprises dyed or colored heat settable plastic powders, known to the art as toner particles, which adhere triboelectrically to coarser carrier granules, such as ferromagnetic granules. The toner particles and carrier granules are selected such that the toner particles have the appropriate charge relative to the electrostatic latent image recorded on the photoconductive member. Thus, when the developer material is brought into contact with the latent image recorded on the photoconductive member, the greater attractive force thereof causes the toner particles to transfer from the carrier granules and adhere to the electrostatic latent image. This process was disclosed originally by Carlson in U.S. Pat. No. 2,297,691 and is further amplified and described by many related patents in the art.

The process of electrophotographic printing was significantly advanced with the advent of multi-color electrophotographic printing. In color electrophotographic printing, filters form single color light images from the colored original document. Each single color light image records a single color electrostatic latent image on the photoconductive member. The single color electrostatic latent image is developed with toner particles of a color complementary to the color of the filtered light image. Thereafter, each differently colored toner powder image is transferred to the copy sheet in superimposed registration with one another. This results in a multi-layered toner powder which is subsequently permanently affixed to the copy sheet. In this manner, the copy sheet has a transparent multi-layered toner powder image formed thereon. Each layer is of a different color. Light rays pass through the multi-layered powder image and reflected from the copy sheet back through the layers to the eye of the observer. Each layer acts as an optical colored filter so that the observer sees an image having a composite color. This results in the observer seeing a copy corresponding in color substantially to the original document being reproduced. U.S. Pat. No. 3,854,449 issued to Davidson in 1974 describes this process in greater detail.

Recently, it has been highly desirable to create flat color, i.e. a copy containing colored information formed as a single layer rather than a multiple layer. This may be achieved by utilized colored toner particles corresponding to all desired colors. This requires that the developer housing storing the toner particles be replaced or differently colored toner particles placed therein to change copy colors. Alternatively, subtractive primary color toner particles may be blended in the developer housing. The ratios of toner particles defines the resultant color of the mixture. In order to vary the color of the mixture, the ratios of the substractive primary color toner particles must be suitably adjusted. Thus, the development system comprises a mixture of cyan, magenta, and yellow toner particles. The ratios of respective toner particles produces a resultant mixture of toner particles having the desired color.

A development control system which regulates the concentration of toner particles in each developer housing of a multi-color electrographic printing machine is described in U.S. Pat. No. 3,754,821 issued to Whited in 1973. This patent describes a control system for regulating the concentration of toner particles in each developer housing employed in a multi-color electrophotographic printing machine. Each developer housing is controlled independently and contains only single color toner particles therein.

Another multi-color electrophotographic printing machine is described in U.S. Pat. No. 3,910,232 issued to Kondo et al in 1975. This patent teaches that developing agents employed in a multi-color development system may be re-used as a black color developing agent. This is achieved by mixing the developing agents in a recovery unit. These differently colored developing agents are mixed with a black colored developing agent so as to be suitable for monochromatic reproduction. The combined developing agent may be utilized for a monochromatic reproduction that is not necessarily black.

Accordingly, it is a primary object of the present invention to improve the development apparatus employed in an electrophotographic printing machine so as to be able to form a mixture of differently colored particles to achieve a resultant pre-selected color therein.

SUMMARY OF THE INVENTION

Briefly stated, and in accordance with the present invention, there is provided a development apparatus.

Pursuant to the features of the present invention, the development apparatus includes means for storing a supply of particles. Means are provided for dispensing a plurality of differently colored particles into the storing means. The dispensing means discharges the particles therefrom in a pre-selected ratio to form a mixture of particles in the storing means having a pre-selected color.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
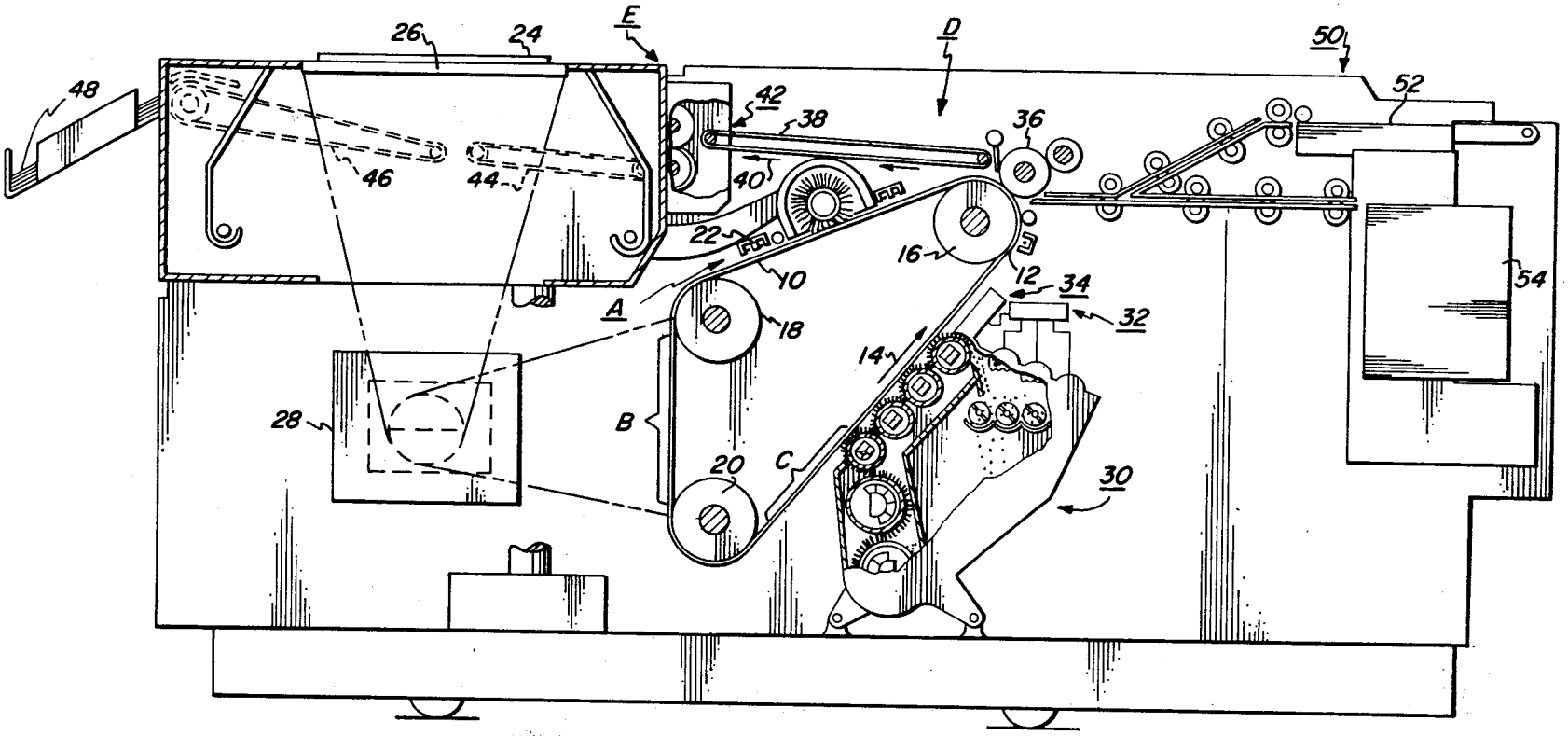
FIG 1 is a schematic elevational view depicting an electrophotographic printing machine incorporating the features of the present invention therein.

For a general understanding of the illustrative electrophotographic printing machine, in which the features of the present invention may be incorporated, refernce is had to the drawings. In the drawings, like reference numerals have been used throughout the designate identical elements. FIG. 1 schematically illustrates the various components of a printing machine having the development system of the present invention incorporated therein. Although the development system is particularly well adapted for use in the electrophotographic printing machine depicted hereinafter, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations depicted in the FIG. 1 printing machine will be shown hereinafter schematically. There operation will only be described briefly with reference to FIG. 1.

Referring now to FIG. 1, the electrophotographic printing machine employs a belt 10 having a photoconductive surface 12. By way of example, photoconductive surface 12 is a suitable selenium alloy deposited on a conductive substrate, such as aluminum. Belt 10 moves in the direction of arrow 14 to advance sequentially through the various processing stations disposed thereabout. Rollers 16, 18 and 20 support belt 10. A drive mechanism, i.e. a suitable motor is coupled to roller 16 so as to advance belt 10 in the direction of arrow 14.

Initially, a portion of belt 10 passes through charging station A. At charging station A, a corona generating device, indicated generally by the reference numeral 22, charges photoconductive surface 12 of belt 10 to a relatively high substantially uniform potential. A suitable corona generating device is described in U.S. Pat. No. 2,836,725 issued to Vyverberg in 1958.

Thereafter, the charged portion of photoconductive surface 12 is advanced by belt 10 to exposure station B. At exposure station B, an original document 24 is placed face down upon a transparent support platen 26. An illumination system flashes light rays upon original document 24 to produce image rays corresponding to the informational areas contained therein. The image rays are projected by means of an optical system 28 onto the charged portion of photoconductive surface 12. In this manner, the charged portion of photoconductive surface 12 is exposed to a light image of the original document. Irradiation of photoconductive surface 12 to the light image selectively discharges the charge thereon in accordance with the intensity of the light image projected thereto. This records an electrostatic latent image on photoconductive surface 12.

Next, the electrostatic latent image recorded on photoconductive surface 12 is advanced by belt 10 to development station C. At development station C, a developer unit, indicated generally by the reference numeral 30, employs a plurality of magnetic brush rollers to deposit toner particles on the electrostatic latent image. The toner particles are formed from a mixture of differently colored toner particles. These toner particles are mixed in a pre-selected ratio so as to form a pre-selected color. Thus, the electrostatic latent image is developed with a mixture of toner particles having a desird preselected color. The color of the toner particle mixture may be suitably adjusted by changing the ratio of the toner particles within the mixture. By way of example, the toner particle mixture comprises cyan toner particles, magenta toner particles and yellow toner particles. Depending upon the ratio of these toner particles to one another, the color of the resultant mixture will vary. For example, a combination of equal parts of yellow and magenta will produce red. Similarly, a combination of equal parts of yellow and cyan will produce green. Finally, a combination of equal parts of magenta and cyan will produce blue. Variations and intermediate shades of these colors may be produced by adjusting the ratio of the differently colored toner particles to one another. For example, equal parts of yellow, magenta, and cyan will result in black. Controller 32 regulates the ratio of differently colored toner particles employed by developer unit 30 and maintains the concentration of toner particles within the developer mix substantially constant. However, the ratio between differently colored toner particles may be suitably varied to obtain a mixture having a desired preselected color. Sensing unit 34 detects the density of the toner powder image recorded on photoconductive surface 12. A sample electrostatic latent image is formed on photoconductive surface 12 and rendered visible by developer unit 30. The density of the toner particles deposited in the sample electrostatic latent image is detected by sensing unit 30. Controller 32, responsive to an electrical signal from sensing unit 34, regulates the dispensing of additional toner particles into developer unit 30 to maintain the concentration of the toner particles within the mixture substantially constant. The developer material contained within developer unit 30 comprises differently colored toner particles and carrier granules having the toner particles triboelectrically attracted thereto. Controller 32 regulates the concentration of toner particles within the developer mix and the ratio of differently colored toner particles with respect to each other. The detailed structure of developer unit 30, controller 32 and sensing unit 34 will be discussed hereinafter with reference to FIGS. 2 and 3. As in all electrophotographic printing processes, the electrostatic latent image attracts electrostatically the toner particles from the carrier granules forming a toner powder image on photoconductive surface 12 of belt 10. The resultant color of the toner particle mixture depends upon the ratio of differently colored toner particles therein.

The toner powder image is transported by photoconductive surface 12 to transfer station D. Transfer station D is located at point of tangency on belt 10 as it moves around roller 16. Transfer roller 36 is disposed at transfer station D with the copy sheet being interposed between transfer roll 38 and photoconductive surface 12 of belt 10. Transfer roller 36 is electrically biased to a suitable magnitude and polarity so as to attract the toner powder image to the surface of the copy sheet in contact therewith. After transferring the toner powder image to the copy sheet, conveyor 38 advances the copy sheet in the direction of arrow 40 to fixing station E.

Fixing station E includes a fuser assembly, indicated generally by the reference numeral 42. Fuser assembly 42 comprises a heated fuser roll and a back-up roll. The surface of the copy sheet having the toner powder image thereon passes between the fuser roll and back-up roll with the toner powder image contacting the fuser roll. In this manner, the toner powder image is permanently affixed to the copy sheet. After fusing, conveyers 44 and 46 advance the copy sheet to catch tray 48.

Briefly referring to the sheet feeding path, sheet transport 50 advances, in seriatum, successive copy sheets from stack 52 or, in lieu thereof, stack 54. The machine programming permits the operator to select the desired stack from which the copy sheet is advanced. In this manner, the selected copy sheet advances to transfer station D where the toner powder image is transferred thereto.

Figure 3:
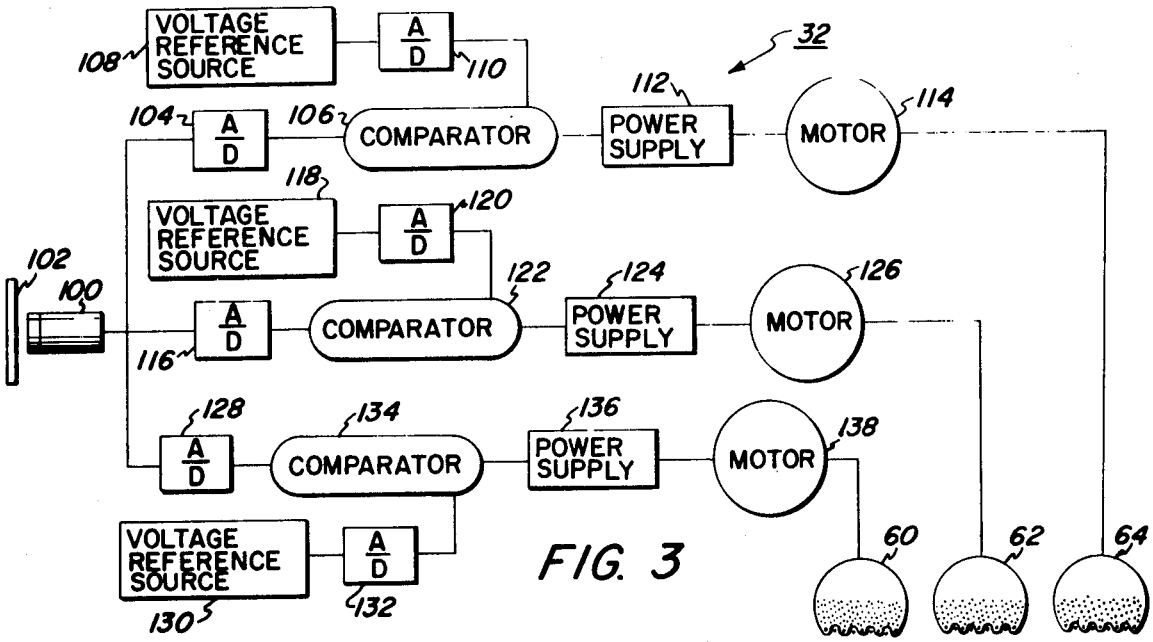
FIG. 3 is a block diagram illustrating the controller employed in the FIG. 2 development apparatus.

It is believed that the foregoing description is sufficient for purposes of the present application to illustrate the general operation of an electrophotographic printing machine incorporating the features of the present invention therein. Referring now to the specific subject matter of the present invention, FIGS. 2 and 3 depict the developer unit and the associate controller and sensor therefor.

Figure 2:
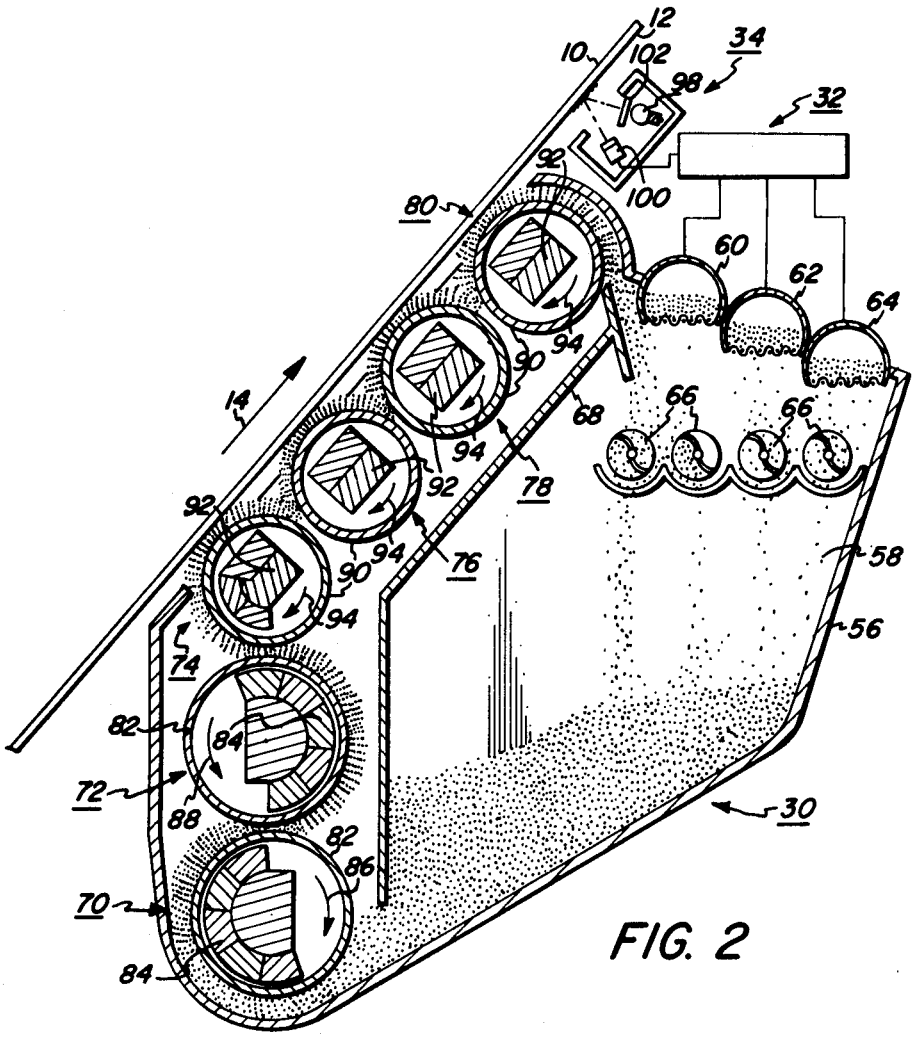
FIG. 2 is a sectional elevational view showing the development apparatus employed in the FIG. 1 printing machine.

Referring now to FIG. 2, there is shown in detailed structure of developer unit 30. As shown therein, housing 56 has a chamber 58 for storing a supply of developer mix therein. Toner particles are added to the developer mix, as required, from toner cartridges 60, 62 and 64. Each of these toner cartridges is a hollow cylindrical member extending the length of housing 56 with perforations in the lower portion thereof. Toner particles are dispensed from the cartridge during oscillation about the longitudinal axis thereof. Toner cartridge 60 comprises cyan toner particles, toner cartridge 62 has magneta toner particles therein, and toner cartridge 64 has yellow toner particles therein. The ratio of the toner particles dispensed from each of the cartridges is regulated so that the resultant toner particle mixture within the developer material is at a pre-selected ratio forming a pre-selected color. Augers 66 mix the toner particles dispensed from cartridges 60, 62 and 64 with the unused developer material and denuded carrier granules dropping from developer 80 to obtain a homoegenous developer material. Baffle plate 68 isolates the transport rollers and developer rollers from sump 58. Transport rollers 70 and 72 advance the developer mix in an upwardly direction to developers rollers 74, 76, 78 and 80. Each transport roller 70 and 72 includes an outer cylinder or tubular member 82 made of non-magnetizable material and extending almost the length of housing 56. Tubular members 82 are mounted for rotation in housing 56. Disposed within each tubular member 82 is a magnet 84. Tubular member 82 of transport roller 70 rotates in the direction of arrow 86. Tubular member 82 of transport roller 72 rotates in the direction of arrow 88. Mounted for rotation within chamber 58 of housing 56 are four magnetic brush developer rollers 74, 76, 78 and 80 positioned with their axis in parallel and adjacent to photoconductive surface 12 of belt 10. Each magnetic brush developer roller comprises an outer cylinder or tubular member 90 made of a non-magnetizable material and extending almost the length of housing 56. Tubular members 90 are mounted for rotation in housing 56. Disposed within each tubular member 90 is a magnet 92. During a development cycle, tubular members 90 rotate in unison with the respective magnets 92 being held substantially stationary. The magnetic field emanating from magnets 92 causes the developer mix to be attracted to the outer surface of tubular members 90. As the tubular members rotate in the direction of arrows 94, the developer material advances across the outer surface of each tubular member 90. In this manner, a brush or bristles of developer material extend in an outwardly direction from housing 56 in contact with the electrostatic latent image recorded on photoconductive surface 12 of belt 10. After passing developer roller 80, the usused developer material is guided by baffle 68 onto auger 66 and is mixed once again with the toner particles dispensed from cartridges 60, 62 and 64. The resultant material falls into chamber 58 of housing 56 for subsequent reuse.

The ratio of differently colored toner particles is regulated by controller 32. In addition, controller 32 maintains the total concentration of toner particles within the developer material substantially constant. Sensing unit 34 detects the density of the sample toner powder image 96 formed on photoconductive surface 12. Sensing unit 34 comprises a light source 98 and a photodetector or photodiode 100. Differently colored optical filters 102 are disposed in front of light source 98 to optimize the color of the light rays transmitted therethrough onto the toner powder image 96.

Thus, an optical filter of a color complimentary to the color of the toner particles being controlled is inserted between light source 98 and toner powder image 86. By way of example, if cartridge 60 having cyan toner particles is being regulated, a red filter is inserted between toner powder image 96 and light source 98. The red light rays are reflected by the cyan toner particles in toner powder image 96 while the yellow and magenta toner particles therein absorb the red light rays. Thus, the intensity of the light rays reflected to photodiode 100 from toner powder image 96 correspond to the density of the cyan toner particles in toner powder image 96. Similarly, if cartridge 62 having magenta toner particles is being regulated, a green filter is inserted between toner powder image 96 and light source 98. Finally, if cartridge 64 having yellow toner particles is being regulated, a blue filter is inserted between toner powder image 96 and light source 98.

Intensity of the light rays reflected from toner powder image 96 are detected by photodiode 100. Photodiode 100 develops an electrical output signal indicative of the density or light absoring mass of the toner powder image. This electrical signal is processed by controller 32. Controller 32 actuated cartridges 60, 62 and 64 to dispense toner particles, in the proper ratio, therefrom into chamber 58 of housing 56. Thus, by controlling the ratio of differently colored toner particles with respect to one another in the developer material, the color thereby may be suitably selected. Though it is readily simple to proceed from a light color to a dark color, in returning from a dark color to a light color, it may be necessary to purge the developer housing of the darker material. This may be achieved by draining the developer material from housing 56 and passing unprocessed magnetite therethrough. The foregoing is described more fully in co-pending application Ser. No. 728,101, filed in 1976, the relevant portions thereof being hereby incorporated into the present application.

Referring now to FIG. 3, the detailed circuitry of controller 32 will be hereinafter described. Controller 32 comprises three substantially identical channels. One channel is associated with each toner particle cartridge. Each channel is controlled by a signal from photodiode 100. An appropriately colored optical filter is interposed between toner powder image 96 and light source 98, depending upon the cartridge being controlled.

Turning initially to the channel for controlling cartridge 64, a blue filter is interposed between light source 98 and toner powder image 96. This channel includes a logic circuit for converting the analog signal from photodiode 100 to a digital signal. The digital signal from logic circuit 104 is transmitted to logic circuit 106 which compares it with a reference signal. The reference signal is produced by a variable voltage source 108. Voltage source 108 includes a constant voltage source connected to a potentiometer. Changes in potentiometer resistance adjust the reference signal. The output from voltage source 108 is processed by logic circuit 110 which converts the analog signal to a digital signal. Logic Circuit 106 develops an error signal. The error signal from logic circuit 106 corresponds to the difference between the signal from photodiode 100 and the reference signal generated by variable voltage source 108. When this signal is nulled, i.e. zero or beneath a prescribed level, power supply 112 remains unactuated. Excitation of power supply 112 energizes motor 114 which oscillates cartridge 64 to dispense toner particles therefrom into the developer material in chamber 58 of housing 56. In this way, additional toner particles from cartridge 64 are added to the developer material.

Turning now to cartridge 62, cartridge 62 is controlled in a similar manner to cartridge 64 with a green filter being interposed between toner powder image 96 and light source 98. Logic circuit 116 converts the analog signal from photodiode 100 to a digital signal. Variable voltage source 118 produces a reference signal. Voltage source 118 also includes a constant voltage source connected to a potentiometer. Similarly, changes in potentiometer resistance adjusts the reference signal. Thus, the ratio of the reference voltages from variable voltage source 118 and variable voltage source 108 are in the same ratio as the quantity of toner particles dispensed from their respective cartridges 64 and 62. The analog signal from variable voltage source 118 is processed by logic circuit 120 and converted to a digital signal. Logic circuit 122 compares the reference signal to the signal from photodiode 100 and generates an error signal. The error signal from logic circuit 122 is transmitted to power supply 124. Excitation of power supply 124 energizes motor 126 which oscillates cartridge 62 to dispense toner particles into the developer material.

Referring now the channel for regulating the discharging of toner particles from cartridge 60, a red filter is interposed between toner powder image 96 and light source 98. This channel also includes a logic circuit 128 for processing the analog signal from photodiode 100 and converting it to a digital signal. The reference signal is produced by variable voltage source 130. Variable voltage source 130 comprises a constant voltage source connected to a potentiometer. Changes in potentiometer resistance adjust the reference signal. The reference signal is processed by logic circuit 132 and coverted from an analog signal to a digital signal. Logic circuit 134 compares the digital reference signal to the digital signal from photodiode 100 and develops an error signal therefrom. The error signal is transmitted to power supply 136. Excitation of power supply 136 energizes motor 138 which oscillates cartridge 60 to dispense toner particles into the developer material.

In this manner, the concentration of toner particles of each color is controlled within the developer mixture. By regulating the concentration of toner particles within the developer material for each of the differently colored toner particles, the total concentration of toner particles within the developer material is also controlled. Thus, the total concentration of toner particles within the developer material is maintained substantially constant as long as the sum of the reference voltages remains constant.

It is evident that the ratio of toner particles in the developer material is controlled by adjusting the ratios of the reference voltages with respect to one another. The foregoing is achieved by adjusting the potentiometers associated with the respective constant voltage sources. In this way, the reference voltages are suitably adjusted and the ratios between each of the reference voltages corresponds to the ratios of the toner particles dispensed into the developer material. However, the sum of the reference voltages must remain constant so that the total concentration of toner particles within the developer material remains constant independent of the ratios.

In recapitulation, the development system of the present invention is capable of forming differently colored mixtures of toner particles within the developer housing by controlling the ratios of toner particles dispensed therein. Thus, the ratios of the cyan, magenta and yellow toner particles with respect to one another forms a resultant toner particle mixture having a pre-selected color. This mixture of toner particles is then employed to develop the electrostatic latent image recorded on the photoconductive surface. The colors of the toner particle mixture may be readily changes adjusting the ratios of cyan, magenta and yellow within the developer material while maintaining the total concentration of toner particles within the developer material constant.

It is, therefore, evident that there has been provided in accordance with the present invention, a development system which has the capability of forming a mixture of differently colored toner particles. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for developing a latent image recorded on a receiving member, including:

means for storing a supply of particles:

means for dispensing a plurality of differently colored particles into said storing means, said dispensing means discharging the particles therefrom in a pre-selected ratio to form a mixture of particles in said storing means having a pre-selected resultant color; and means for depositing the mixture of differently colored particles on the latent image recorded on the receiving member.

2. An apparatus as recited in claim 1, wherein said dispensing means includes:

a plurality of containers in communication with said storing means with each of said plurality of containers having differently colored particles therein; and means for controlling said plurality of containers to discharge the particles therefrom in the pre-selected ratio forming the mixture of particles in said storing means having the pre-selected color.

3. An apparatus as recited in claim 2, wherein said controlling means regulates the quantity of differently colored particles in said storing means while maintaining the pre-selected ratio between the differently colored particles substantially constant.

4. An apparatus as recited in claim 3, wherein said controlling means includes:

means for detecting the density of particles deposited on said receiving member and generating an output signal indicative thereof;

operator adjustable means for generating a plurality of different reference signals in the preselected ratio, each reference signal being associated with one of said plurality of containers;

means for comparing the output signal with each reference signal and generating a plurality of error signals; and means, responsive to the error signals, for actuating said plurality of containers to discharge particles into said storing means in the pre-selected ratio and quantity forming the mixture of particles in said storing means having the pre-selected resultant color.

5. An apparatus as recited in claim 4, wherein said detecting means includes:

a light source generating light rays to illuminate the particles deposited on said receiving member;

means for filtering the light rays illuminating the particles; and a photosensor for detecting the intensity of the filtered light rays transmitted from the particles deposited on said receiving member.

6. An apparatus as recited in claim 3, wherein said depositing means includes means for mixing the differently colored particles in said storing means to form the mixture of colored particles having the pre-selected resultant color.

7. An apparatus as recited in claim 6, wherein said mixing means includes a plurality of augers disposed in said storing means and arranged to receive the particles discharged from said containers.

8. An apparatus as recited in claim 6, wherein said depositing means includes at least one magnetic brush roller located in said storing means and positioned closely adjacent to said receiving means to deposit the mixture of colored particles thereon.

9. An apparatus as recited in claim 8, wherein:

a first one of said plurality of containers stores a supply of cyan particles therein;

a second one of said plurality of containers stores a supply of magenta particles therein; and a third one of said plurality of containers stores a supply of yellow particles therein.

10. An electrophotographic printing machine of the type having an electrostatic latent image recorded on a photoconductive member and an apparatus for developing the electrostatic latent image, wherein the improved development apparatus includes:

means for storing a supply of developer material comprising carrier granules and differently colored toner particles;

means for dispensing a plurality of differently colored toner particles into said storing means with said dispensing means discharging the toner particles therefrom in a pre-selected ratio to form a mixture of toner particles in said storing means having a pre-selected resultant color; and means for depositing the mixture of differently colored toner particles on the latent image recorded on the photoconductive member.

11. A printing machine as recited in claim 10, wherein said dispensing means includes:

a plurality of containers in communication with said storing means with each of said plurality of containers having differently colored toner particles therein; and means for controlling said plurality of containers to discharge the toner particles therefrom in the pre-selected ratio forming the mixture of toner particles in the storing means having the pre-selected resultant color.

12. A printing machine as recited in claim 11, wherein said controlling means regulates the quantity of differently colored toner particles in said storing means while maintaining the pre-selected ratio between the differently colored toner particles substantially constant.

13. A printing machine as recited in claim 12, wherein said controlling means includes:

means for detecting the density of toner particles deposited on the photoconductive member and generating on output signal indicative thereof;

operator adjustable means for generating a plurality of different reference signals in the pre-selected ratio, each reference signal being associated with one of said plurality of containers;

means for comparing the output signal with each reference signal and generating a plurality of error signals; and means, responsive to the error signals, for actuating said plurality of containers to discharge toner particles into said storing means in te pre-selected ratio and quantity forming the mixture of toner particles in the storing means having the pre-selected resultant color.

14. A printing machine as recited in claim 13, wherein said detecting means includes:

a light source generating the light rays to illuminate the toner particles deposited on the photoconductive member;

means for filtering the light rays illuminating the toner particles; and a photosensor for detecting the intensity of the light rays transmitted from the toner particles deposited on the photoconductive member.

15. A printing machine as recited in claim 12, wherein sid depositing means includes means for mixing the differently colored toner particles in said storing means to form a mixture of toner particles therein having the pre-selected resultant color.

16. A printing machine as recited in claim 15, wherein said mixing means includes a plurality of augers disposed in said storing means and arranged to receive the particles discharged from said containers.

17. A printing machine as recited in claim 14, wherein said depositing means includes at least one magnetic brush roller located in said storing means and positioned closely adjacent to the photoconductive member to deposit the mixture of colored toner particles on the electrostatic latent image recorded thereon.

18. A printing machine as recited in claim 17, wherein:

a first one of said plurality of containers stores a supply of cyan particles therein;

a second one of said plurality of containers stores a supply of magenta particles therein; and a third one of said plurality of containers stores a supply of yellow toner particles therein.

* * * * *